US007205945B2

(12) United States Patent
Fukushima

(10) Patent No.: US 7,205,945 B2
(45) Date of Patent: Apr. 17, 2007

(54) ANTENNA AND ELECTRONIC DEVICE USING THE SAME

(75) Inventor: Susumu Fukushima, Katano (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 128 days.

(21) Appl. No.: 10/524,895

(22) PCT Filed: Jun. 8, 2004

(86) PCT No.: PCT/JP2004/008273

§ 371 (c)(1),
(2), (4) Date: Feb. 17, 2005

(87) PCT Pub. No.: WO2004/109858

PCT Pub. Date: Dec. 16, 2004

(65) Prior Publication Data

US 2006/0044193 A1 Mar. 2, 2006

(30) Foreign Application Priority Data

Jun. 9, 2003 (JP) ..... 2003-163612

(51) Int. Cl.
*H01Q 1/24* (2006.01)

(52) U.S. Cl. ..... 343/702; 343/846

(58) Field of Classification Search ..... 343/702, 343/895, 715, 846
See application file for complete search history.

(56) References Cited

U.S. PATENT DOCUMENTS 2,533,529 A * 12/1950 Spindier ..... 343/702
3,543,273 A * 11/1970 Perkins ..... 343/702
5,629,713 A * 5/1997 Mailandt et al. ..... 343/808
5,990,838 A * 11/1999 Burns et al. ..... 343/702
2002/0057227 A1* 5/2002 Fang ..... 343/895

FOREIGN PATENT DOCUMENTS

| | | | |
|---|---|---|---|
| JP | 58-188905 | A | 11/1983 |
| JP | 61-007706 | A | 1/1986 |
| JP | 07-007321 | A | 1/1995 |
| JP | 3048535 | U | 2/1998 |
| JP | 11-239020 | A | 8/1999 |
| JP | 11-274828 | A | 10/1999 |
| JP | 2000-183635 | A | 6/2000 |
| JP | 2001-345636 | A | 12/2001 |
| JP | 2002-009534 | A | 1/2002 |
| JP | 2002-232227 | | 8/2002 |

OTHER PUBLICATIONS

English translation of International Search Report for PCT/JP2004/008273, dated Jul. 20, 2004.

* cited by examiner

*Primary Examiner*—Tan Ho
(74) *Attorney, Agent, or Firm*—RatnerPrestia

(57) ABSTRACT

A circularly polarized wave antenna is an antenna having two or more electrically conductive elements and a high frequency circuit, wherein at least two of the plurality of electrically conductive elements are constructed in V-shape with an angle of 90 degrees; therefore, it is possible to realize a circularly polarized wave antenna of simple construction having directivity gains in multi-direction.

11 Claims, 22 Drawing Sheets

ANTENNA AND ELECTRONIC DEVICE USING THE SAME

THIS APPLICATION IS A U.S. NATIONAL PHASE APPLICATION OF PCT INTERNATIONAL APPLICATION PCT/JP2004/008273.

TECHNICAL FIELD

The present invention relates to an antenna capable of being used for a radio communication device such as a mobile device.

BACKGROUND ART

FIGS. 22A–22C show the antenna disclosed in Japanese Patent Laid-Open Application No. 2002-232227. In a case where the antenna has a bandwidth of 100 MHz with a center frequency of 2450 MHz, a dielectric substrate with a dielectric constant of 8 is processed to have a size of 26 mm×26 mm and a thickness of 6 mm. Then, a patch electrode (hereinafter referred to as patch) 101 of 20 mm×20 mm is formed on the surface of the substrate so as to complete antenna element 100. The midpoints of two opposing sides of patch 101 are connected with each other, and the midpoints of the other two opposing sides of patch 101 are connected with each other so as to form two lines intersecting at right angles. On these two lines, one power feed pin 102 is inserted in each of the two 50 Ω points (not an edge of the patch, but inside the patch), thereby resulting in two independent microstrip antennas whose polarization axes in the directions X and Y are orthogonal to each other. Wiring board 103 has a ground pattern on one entire side thereof except for a nonconductive region provided for power feed pins 102 of antenna element 100, and the ground pattern is the ground conductor of antenna element 100. Electric power is fed by power feed terminal 106 via hybrid circuit 105, and connection with an external circuit is performed via coaxial line 104. This structure can achieve a circularly polarized antenna with excellent axial ratio characteristics in a broad frequency range.

A problem of this conventional antenna is a complicated fabrication process. Specifically, the antenna has the power feed point not at an edge of the patch, but inside the patch, so that power feed pin 102 has to penetrate the dielectric member, thereby complicating the fabrication process.

Furthermore, the conventional antenna can radiate circular polarization only towards the top side of the ground pattern on which the patch antenna is mounted, and it is impossible to transmit signals towards the bottom side of the ground pattern. Providing directivity towards the bottom side requires disposing a microstrip antenna also on the bottom side of the ground pattern, and this leads to the problem of an increase in the cost and size of the antenna.

In addition, conventional antenna element 100 is made of a conductive pattern formed on the surface of wiring board 103 that has no components mounted thereon. If a patch antenna is disposed on wiring board 103 in order to have the directivity towards the bottom side, then no room is left for hybrid circuit 105. Consequently, a total of two hybrid circuits 105 have to be formed in a layer in wiring board 103, thereby further complicating the antenna structure and making antenna designing extremely difficult.

SUMMARY OF THE INVENTION

The present invention is a circularly polarized antenna which includes a plurality of conductive elements and a high frequency circuit, and which can have directional gains in multi directions with a simple structure by arranging at least two of the conductive elements to form the letter "V" with an angle of 90° so as to radiate a plurality of circularly polarized waves.

DESCRIPTION OF THE INVENTION

Figure 1:
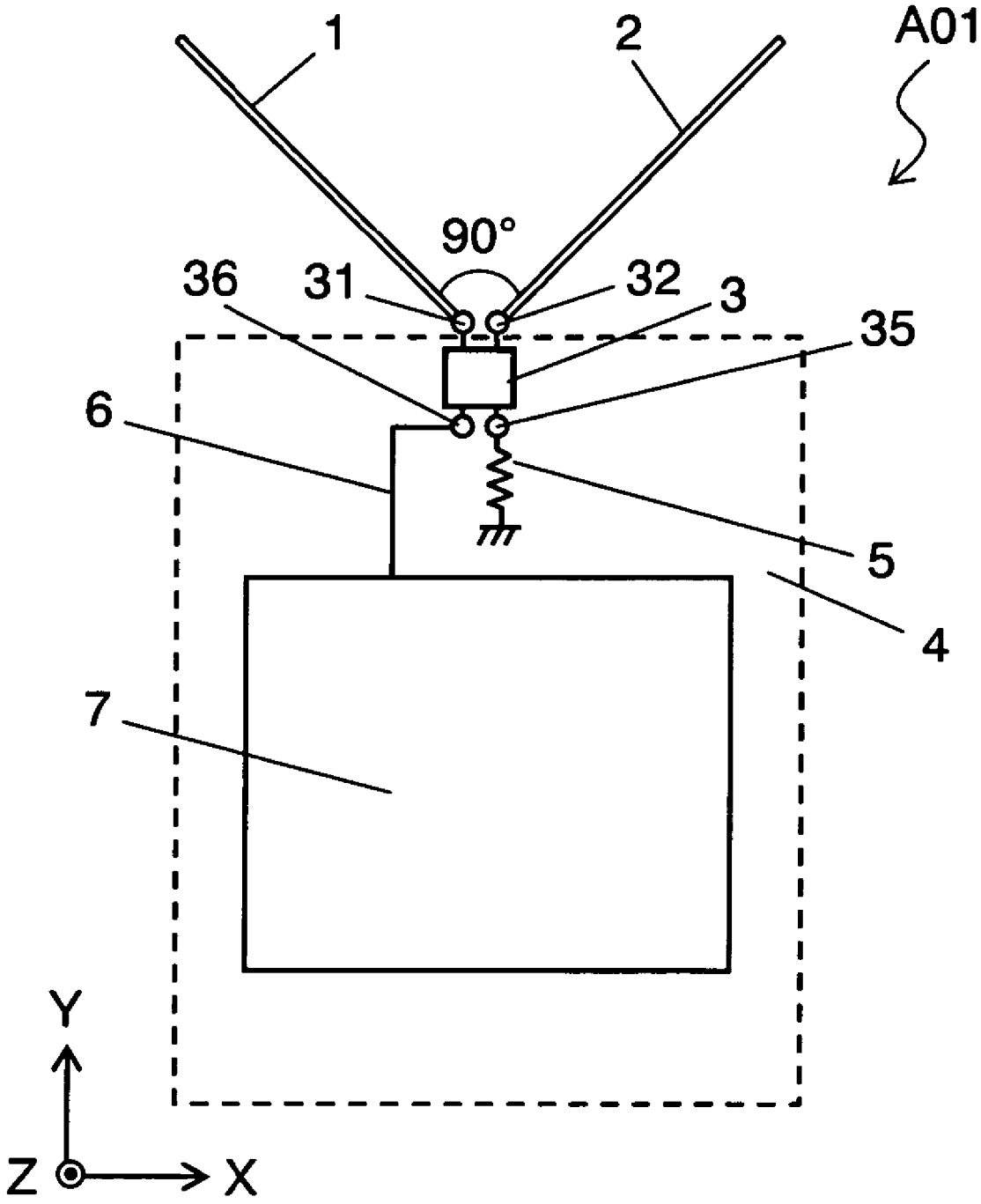
FIG. 1 is a top view of an antenna according to an embodiment of the present invention.

The antenna of the present invention may include a plurality of conductive elements and a high frequency circuit, and may arrange at least two of the conductive elements to form the letter "V" with an angle of 90° so as to radiate a plurality of circularly polarized waves.

The antenna of the present invention may include two conductive elements which are arranged to form the letter "V" with an angle of 90°, a power feed circuit which feeds each of the conductive elements the same signal power with a phase difference of 90° and a high frequency circuit. In this antenna the conductive elements are disposed with an angle of 90° and are fed power with a phase difference of 90°, so that it becomes possible to radiate circularly polarized waves in the directions (hereinafter referred to as the vertical directions for the sake of convenience) orthogonal to the surface where the two conductive elements are present.

When the power feed circuit in the antenna of the present invention is made up of a hybrid circuit, the two conductive elements can be fed the same signal power with a phase difference of 90°. Specifically, employing a hybrid circuit enables both the hybrid circuit and the two conductive elements to be made of a conductive pattern formed on the high frequency printed circuit board, so that an antenna capable of radiating circularly polarized waves in the vertical directions can be fabricated in a simple structure and at low cost.

The antenna of the present invention may have two conductive elements which are arranged to form the letter "V" with an angle of 90° and which are electrically connected with each other at one end corresponding to the bottom of the letter "V", and the connected end may be further connected with a high frequency circuit. Let the straight line direction between the tips of the two conductive elements be axis X, and the direction perpendicular to the surface where the two conductive elements are present be axis Z. In a case where the elevation angle from axis X to axis Z is about 30 to 60°, 120 to 150°, −30 to −60° and −120 to −150°, the signals that are radiated from the two conductive elements into which power is fed at the same phase are spatially combined with a phase difference of 90°, and the electric field vectors of the signals have directions orthogonal to each other. This makes it possible to radiate a circularly polarized wave in each elevation angle direction. In other words, an antenna capable of radiating circularly polarized waves in four directions can be easily achieved without using a hybrid circuit.

The antenna of the present invention may include conductive elements, which are disposed at an end of the ground of a high frequency circuit. As compared with a case where radiant elements are disposed in a site other than an end of the ground, the electromagnetic coupling between the ground and the conductive elements can be reduced, thereby achieving excellent axial ratio characteristics.

The antenna of the present invention may include two conductive elements which are arranged to form the letter "V" and whose base parts are disposed at an apex of about 90° of a corner on the ground of a high frequency circuit. The conductive elements have a radiation pattern in which the highest gain appears in the direction perpendicular to the axes of the conductive elements, so that the two conductive elements are disposed at a corner of about 90° on the ground so as not to dispose the ground in the direction having the highest gain. This can reduce the electromagnetic couple between the ground and the conductive elements, thereby achieving excellent axial ratio characteristics.

The antenna of the present invention may include conductive elements which are in a helical shape, a meander shape, or a zigzag shape. Making the conductive elements helical or meander can reduce the antenna in size.

In the antenna of the present invention, a least one of the power feed circuit and the conductive elements may be made of a conductive pattern formed on a high frequency printed circuit board. In this antenna, impedance characteristics and axial ratio characteristics can be easily controlled by adjusting the lengths of the conductive elements by grinding their ends. In addition, a circularly polarized antenna can be formed, including a hybrid circuit, on a high frequency printed circuit board. Thus, a circularly polarized antenna with the advantage of easy adjustment can be achieved at low cost.

In the antenna of the present invention, the conductive elements may be formed either on or inside the substrate made of dielectric ceramic material or magnetic material. The physical lengths of the conductive elements can be reduced by using material with high dielectric constant and high relative permeability such as Bi—Nb—O, Bi—Ca—Nb—O, Ba—Nb—Ti—O, Bi—Ca—Zn—Nb—O or Al—Mg—Sm—O, thereby miniaturizing a circularly polarized antenna.

In the antenna of the present invention, the conductive elements may have an electric length of about λ/2. Using the conductive elements with the electric length of about λ/2 makes it harder to pass resonance current through the ground, so that most of the fed signals are radiated from the conductive elements, thereby suppressing the radiation from the ground. Consequently, a circularly polarized antenna with excellent axial ratio characteristics can be achieved by a single antenna.

The antenna of the present invention has a feature that the two conductive elements disposed at an end of the ground of an antenna including the high frequency circuit are on a surface orthogonal to the surface of the ground. The positional relation between the conductive elements and the ground which are orthogonal to each other makes it possible to reduce their coupling and to suppress unnecessary radiation power from the ground. As a result, excellent axial ratio characteristics can be achieved.

The electronic device according to the present invention uses the antenna according to the present invention. The inexpensive miniature electronic device can be achieved by using the inexpensive antenna with a simple structure capable of radiating circularly polarized waves in the four directions of the elevation angles ±45° and ±135° with respect to the vertical directions or the horizontal surface. This antenna can be effectively used, for example, as the transmitter antenna of a wireless LAN with not only linear polarization but also circular polarization in order to reduce the influence of multipath fading.

DETAILED DESCRIPTION OF PREFERRED EMBODIMENT

The antenna and electronic device using the antenna according to the present invention will be described in the following embodiment. Examples 1 to 9 will specifically describe the embodiment of the present invention which can radiate a plurality of circularly polarized waves.

FIG. 1 shows antenna A01 according to a first example of the present invention. Antenna A01 includes two conductive elements 1 and 2 which are linear and arranged to form the letter "V" with an angle of about 90°; hybrid circuit 3 which feeds signals into conductive elements 1 and 2 via antenna-side terminals 31 and 32; and ground plate 4 which is disposed separately from hybrid circuit 3 by a certain distance. Two conductive elements 1 and 2 are disposed outside ground plate 4 so as to ease the electromagnetic coupling developed between the ground plate 4 and conductive elements 1, 2. Circuit-side terminals 35, 36 of hybrid circuit 3 are respectively connected with terminator 5 and feed line 6, and the other end of feed line 6 is connected with high frequency circuit 7. Feed line 6 is isolated from ground plate 4 by a certain distance. Specifically, feed line 6 is made up of a microstrip line or the like. The other end of terminator 5 is short-circuited to ground plate 4. The signals fed into conductive elements 1 and 2 from antenna-side terminals 31 and 32 have nearly the same signal power, but have a phase difference of 90°. For example, when the signal to conductive element 1 is 90° ahead of the signal to conductive element 2 in phase, a right-hand circularly polarized wave is radiated in the direction of axis +Z, and a left-hand circularly polarized wave is radiated in the direction of axis −Z.

Figure 2A:
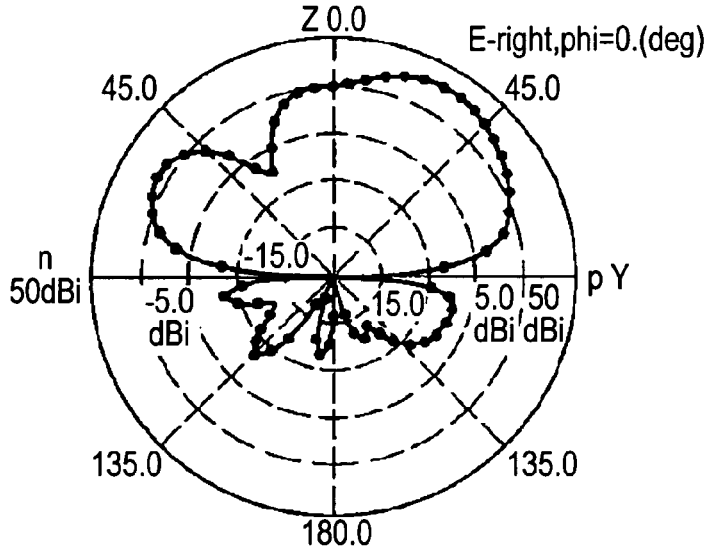
FIG. 2A is a view showing right-hand circular polarization radiation characteristics when conductive elements according to the embodiment of the present invention have an element length of λ/2.
Figure 2B:
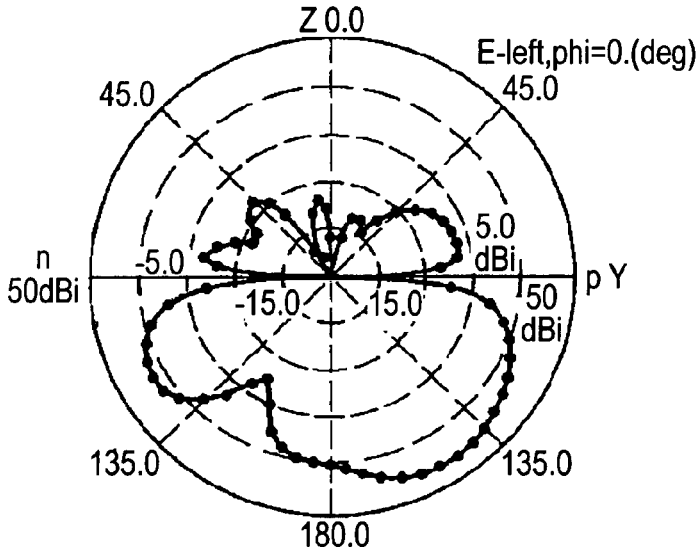
FIG. 2B is a view showing left-hand circular polarization radiation characteristics when the conductive elements according to the embodiment of the present invention have an element length of λ/2.
Figure 2C:
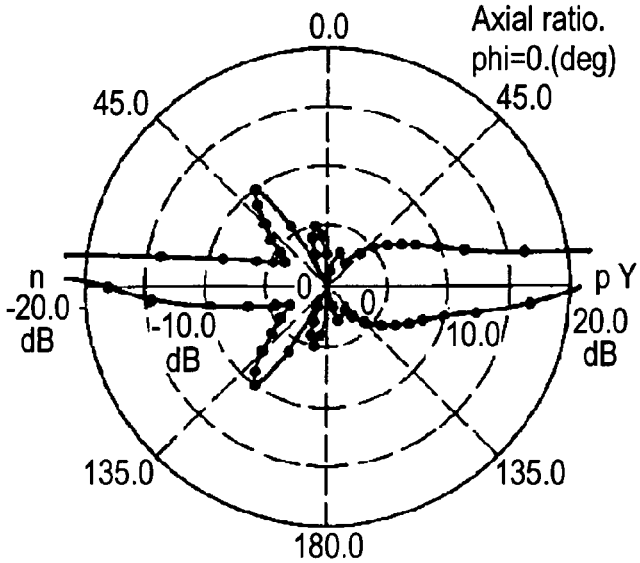
FIG. 2C is a view showing axial ratio characteristics when the conductive elements according to the embodiment of the present invention have an element length of λ/2.

FIGS. 2A–2C show the radiation characteristics on surface YZ in a case where conductive elements 1 and 2 have an electric length of about λ/2. FIG. 2A shows a radiation pattern in right-hand circular polarization and FIG. 2B shows a radiation pattern in left-hand circular polarization. It is apparent from these views that the circularly polarized waves are radiated in nearly all directions except for the horizontal direction. FIG. 2C shows the axial ratio characteristics on surface YZ, which exhibits excellent axial ratio characteristics in a wide range except for the vicinity of axis Y. Thus, a simple antenna structure with only two linear conductive elements can achieve an antenna capable of radiating circularly polarized waves in a wide angle region.

Figure 3A:
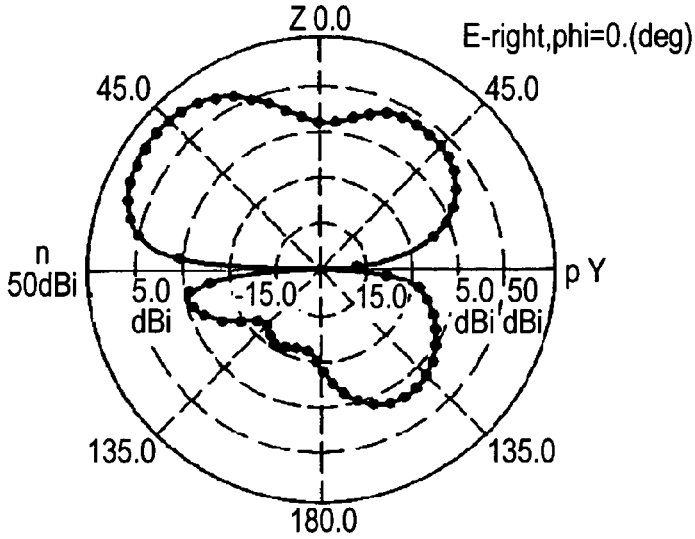
FIG. 3A is a view showing right-hand circular polarization radiation characteristics when the conductive elements according to the embodiment of the present invention have an element length of λ/4.
Figure 3B:
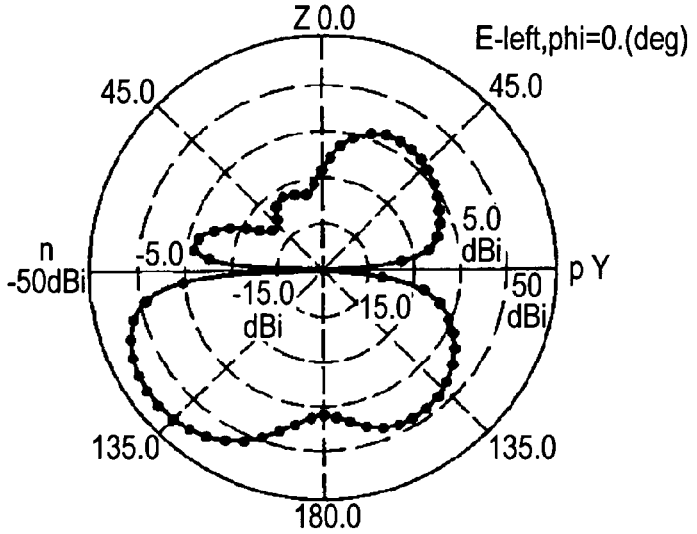
FIG. 3B is a view showing left-hand circular polarization radiation characteristics when the conductive elements according to the embodiment of the present invention have an element length of λ/4.
Figure 3C:
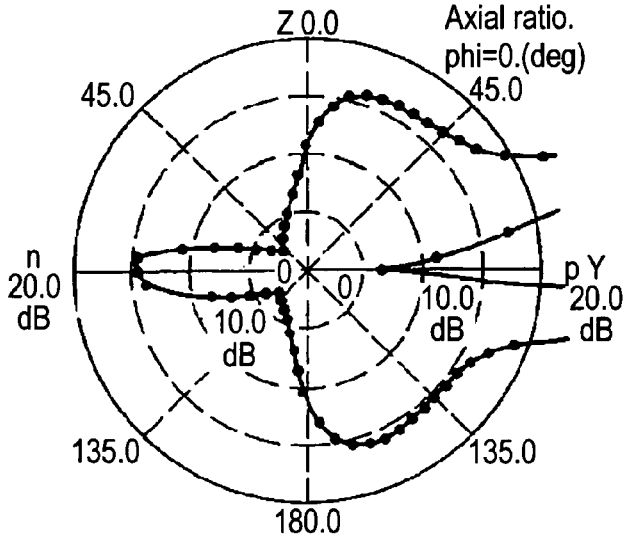
FIG. 3C is a view showing axial ratio characteristics when the conductive elements according to the embodiment of the present invention have an element length of λ/4.

FIGS. 3A–3C show the radiation patterns on surface YZ in a case where conductive elements 1 and 2 have an electric length of about λ/4. FIG. 3A shows a radiation pattern in right-hand circular polarization and FIG. 3B shows a radiation pattern in left-hand circular polarization. In FIGS. 3A and 3B, the radiation gains in the direction of axis −Y are larger than in the radiation patterns shown in FIGS. 2A and 2B. This is because more resonance current flows on ground plate 4 than in the case with conductive elements 1 and 2 having the electric length of λ/2. In contrast, in the case with conductive elements 1 and 2 whose electric length is λ/2, the flow of resonance current on ground plate 4 is small, and most of the fed power flows on conductive elements 1 and 2, thereby making the radiation gains in the direction of axis +Y large (See FIGS. 2A and 2B).

FIG. 3C shows the axial ratio characteristics on surface YZ when conductive elements 1 and 2 having an electric length of λ/4 are used. The axial ratio characteristics in FIG. 3C are inferior to those shown in FIG. 2C, and this is due to the radiation from the resonance current flowing to ground plate 4.

Thus, when there is enough room to install an antenna, it is preferable to use conductive elements 1 and 2 whose electric length is λ/2 so as to achieve excellent axial ratio characteristics in a wider angle range.

Figure 4:
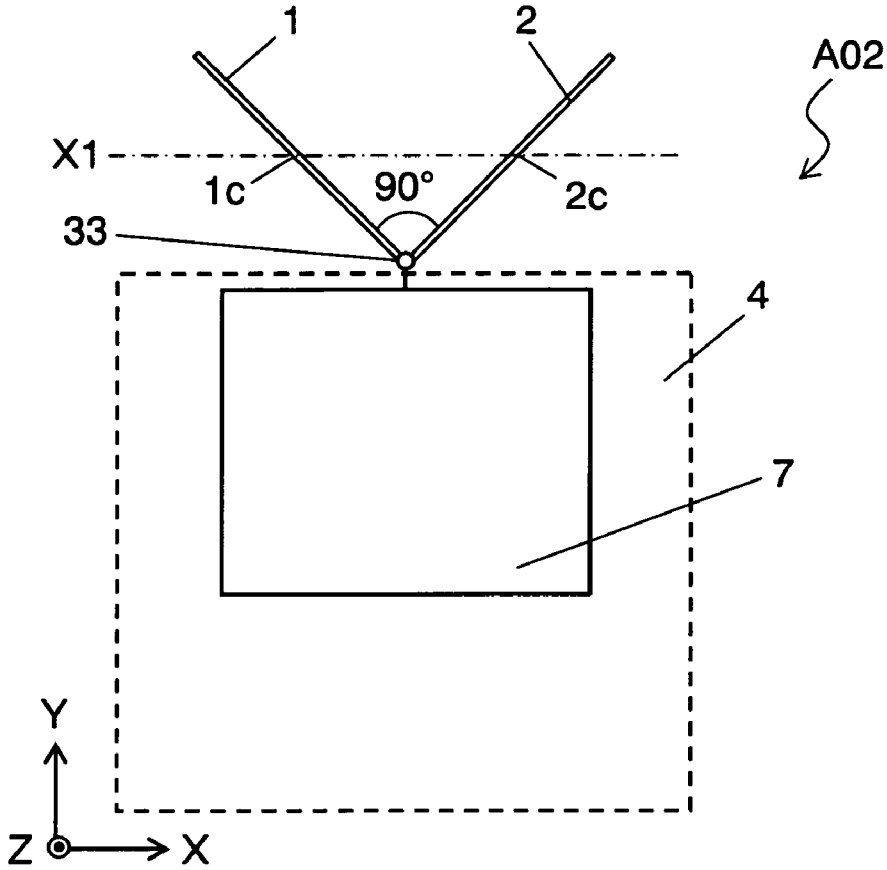
FIG. 4 is a top view of an antenna according to the embodiment of the present invention.

FIG. 4 shows a second example of the present invention. Antenna A02 shown in FIG. 4 includes conductive elements 1 and 2 which are arranged to form the letter "V" with an angle of about 90° and which have an electric length of about λ/2; connection point 33 which electrically connects conductive elements 1 and 2 at one end of each; and high frequency circuit 7 connected to connection point 33. Two conductive elements 1 and 2 are disposed outside ground plate 4 so as to be isolated therefrom, thereby reducing the electromagnetic coupling between ground plate 4 and two conductive elements 1, 2. Employing the conductive elements whose electric length is λ/2 makes it harder to pass the resonance current through ground plate 4, making most of the fed signal power flow on conductive elements 1 and 2. In this case, conductive elements 1 and 2 have the largest current at around the midpoints (1*c* and 2*c* in FIG. 4), and have the smallest at both ends.

Figure 5:
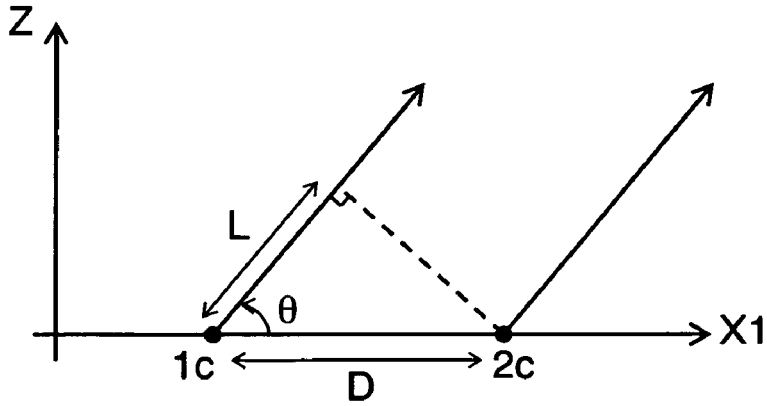
FIG. 5 is a schematic diagram showing radiation direction in the embodiment of the present invention.

FIG. 5 is a schematic view of the radiation direction in straight line X1 shown in FIG. 4. FIG. 5 shows distance D between midpoints 1*c* and 2*c* of two conductive elements 1 and 2, and differential distance L between the electromagnetic waves radiated from midpoints 1*c* and 2*c* in the direction of angle θ in the same phase. At the angle θ where distance L is equal to λ/4 of the use frequency, signals from midpoints 1*c* and 2*c* make phase difference of 90° each other. There are four angles θ that satisfy this requirement. At each of the angles the electromagnetic waves radiated from midpoints 1*c* and 2*c* are spatially combined with a phase difference of 90°, and their vectors intersect almost at right angles, so that circularly polarized waves can be radiated. According to this principle of operation, an antenna capable of radiating circularly polarized waves in four directions can be achieved with the simple structure shown in FIG. 4 using no hybrid circuit.

Figure 6A:
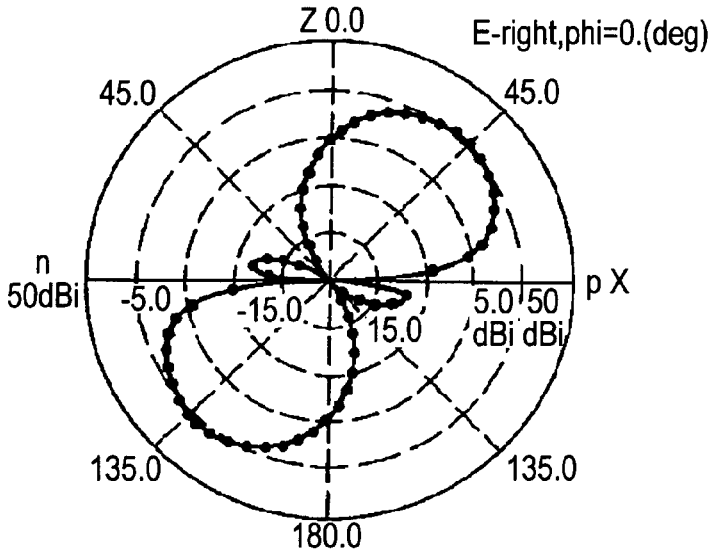
FIG. 6A is a view showing right-hand circular polarization radiation characteristics when conductive elements according to the embodiment of the present invention have an element length of λ/2.
Figure 6B:
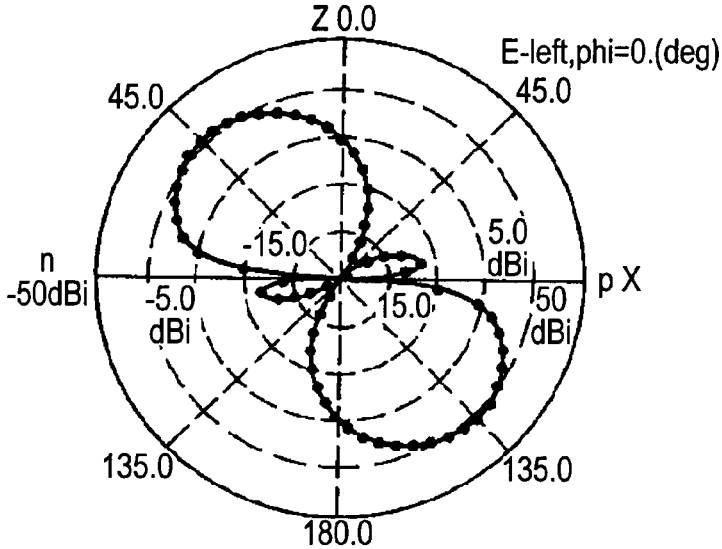
FIG. 6B is a view showing left-hand circular polarization radiation characteristics when the conductive elements according to the embodiment of the present invention have an element length of λ/2.
Figure 6C:
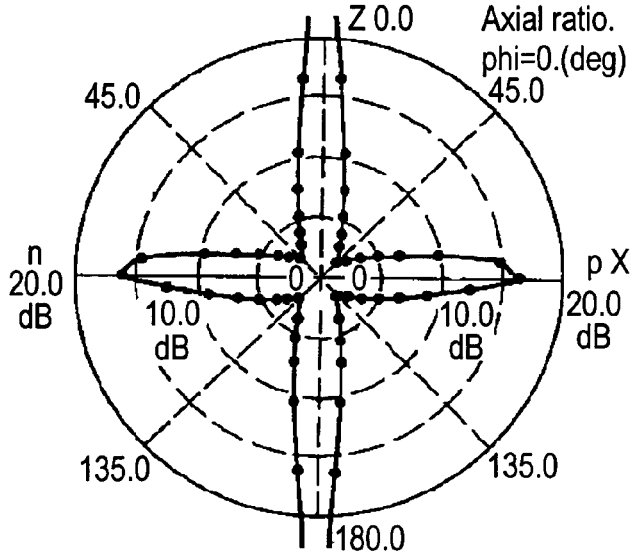
FIG. 6C is a view showing axial ratio characteristics when the conductive elements according to the embodiment of the present invention have an element length of λ/2.

FIGS. 6A–6C show the radiation characteristics on surface ZX of the antenna of FIG. 4. FIG. 6A shows a radiation pattern in right-hand circular polarization, FIG. 6B shows a radiation pattern in left-hand circular polarization, and it is apparent from these views that the right-hand and left-hand circularly polarized waves are radiated with an angle of about 90° therebetween. FIG. 6C shows the axial ratio characteristics on surface ZX, and indicates that excellent axial ratio characteristics are achieved in a wide region except for axes X and Z.

Figure 7:
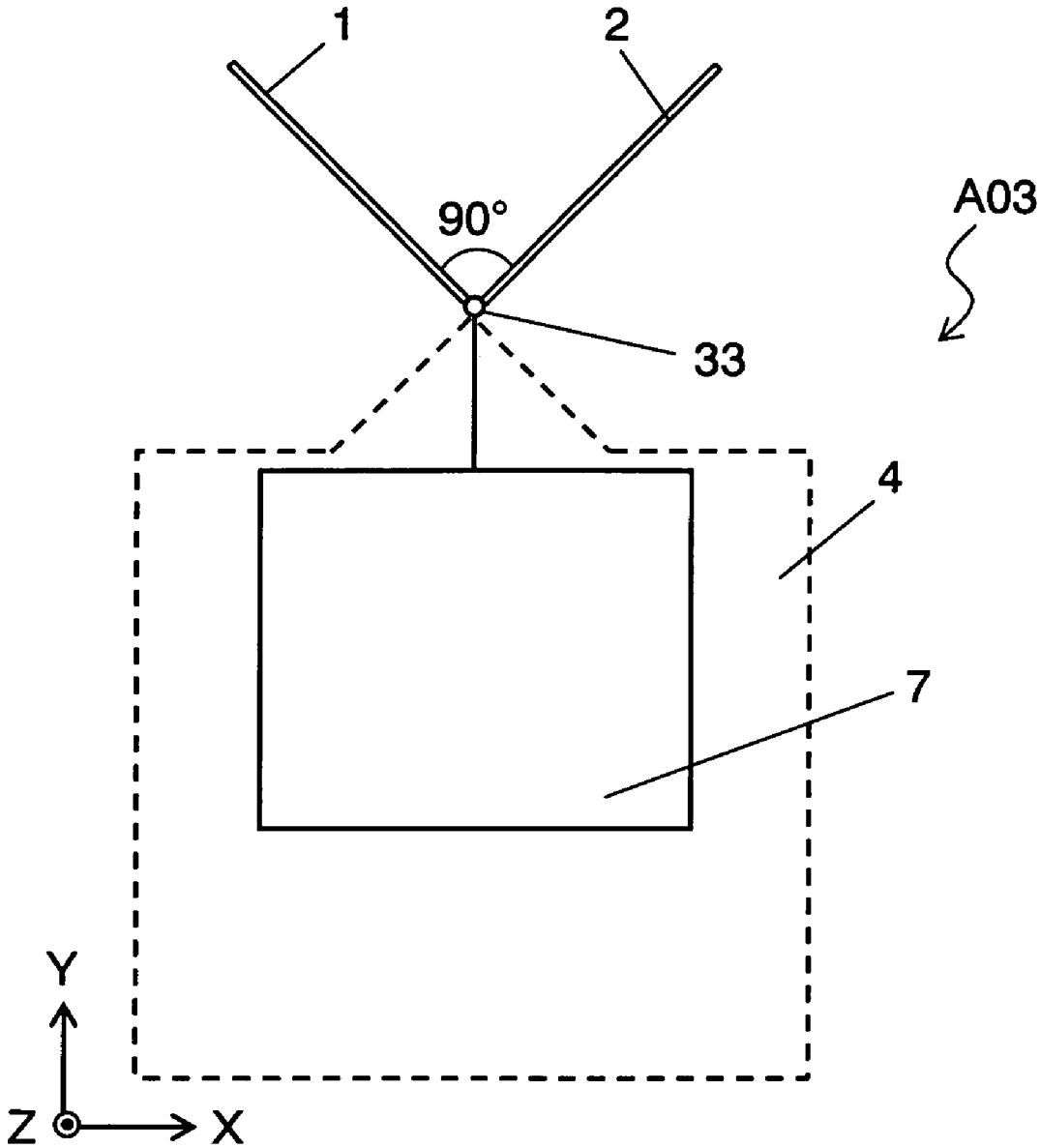
FIG. 7 is a top view of an antenna according to the embodiment of the present invention.

FIG. 7 shows a third example of the present invention. Antenna A03 shown in FIG. 7 includes the same components as antenna A02 according to the second example, but differs in the shape of ground plate 4 in the vicinity of connection point 33 between two conductive elements 1 and 2. As shown in FIG. 7, ground plate 4 has a triangular part pointed towards connection point 33 in order to reduce the electromagnetic coupling between ground plate 4 and conductive elements 1, 2. The highest radiation gain from conductive elements 1 and 2 appears in the directions orthogonal to the axes of conductive elements 1 and 2. Therefore, in order to minimize the area of ground plate 4 that is in the orthogonal direction, it is effective to shape ground plate 4 as shown in FIG. 7.

Figure 8A:
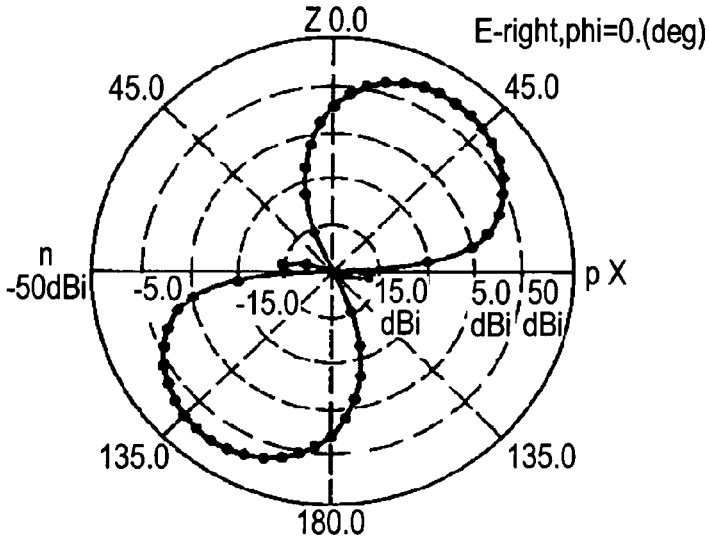
FIG. 8A is a view showing right-hand circular polarization radiation characteristics when conductive elements according to the embodiment of the present invention have an element length of λ/2.
Figure 8B:
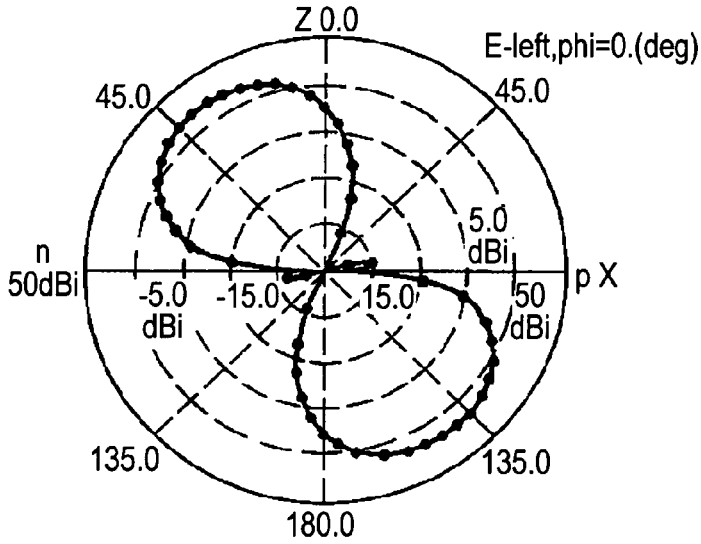
FIG. 8B is a view showing left-hand circular polarization radiation characteristics when the conductive elements according to the embodiment of the present invention have an element length of λ/2.
Figure 8C:
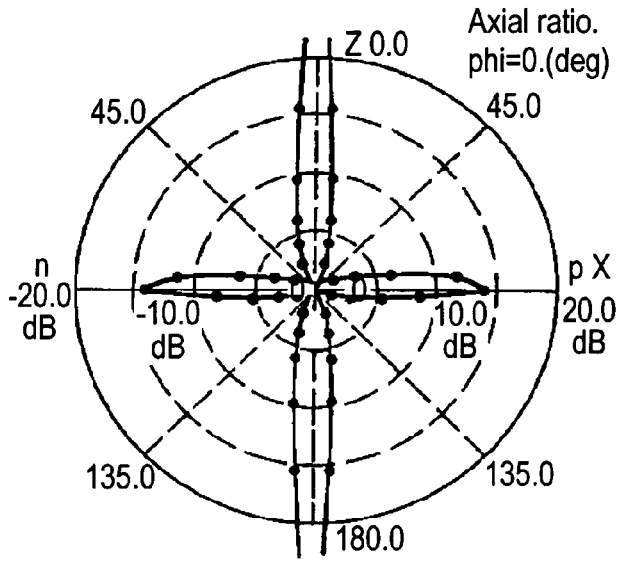
FIG. 8C is a view showing axial ratio characteristics when the conductive elements according to the embodiment of the present invention have an element length of λ/2.

FIGS. 8A–8C show the radiation characteristics on surface ZX of the antenna shown in FIG. 7. FIG. 8A shows a radiation pattern in right-hand circular polarization, FIG. 8B shows a radiation pattern in left-hand circular polarization and FIG. 8C shows axial ratio characteristics. It is apparent that the axial ratio characteristics are better than in FIGS. 6A–6C. The improvement in the characteristics results from a reduction in the radiation from the resonance current induced by ground plate 4 as a result of the reduced electromagnetic coupling with ground plate 4.

Figure 9:
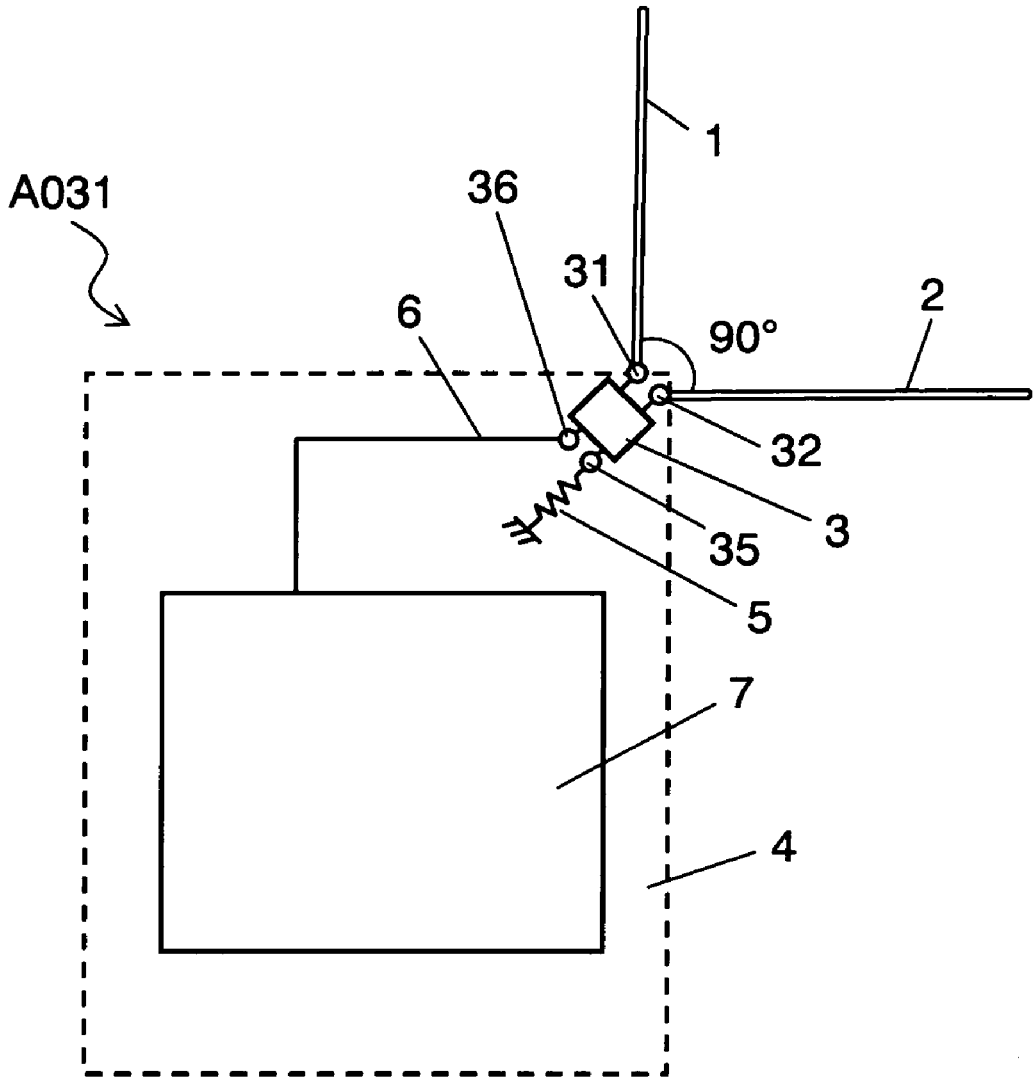
FIG. 9 is a top view of another antenna according to the embodiment of the present invention.

It goes without saying that excellent axial ratio characteristics can be obtained in a case where conductive elements 1 and 2 are disposed at a corner of ground plate 4 as shown in FIG. 9 by the same idea as in the third example. Employing antenna A031 having the structure shown in FIG. 9 can obtain the effect of reducing the electromagnetic coupling even when the surface including conductive elements 1 and 2 is disposed orthogonal to the surface where ground plate 4 is present.

Figure 10A:
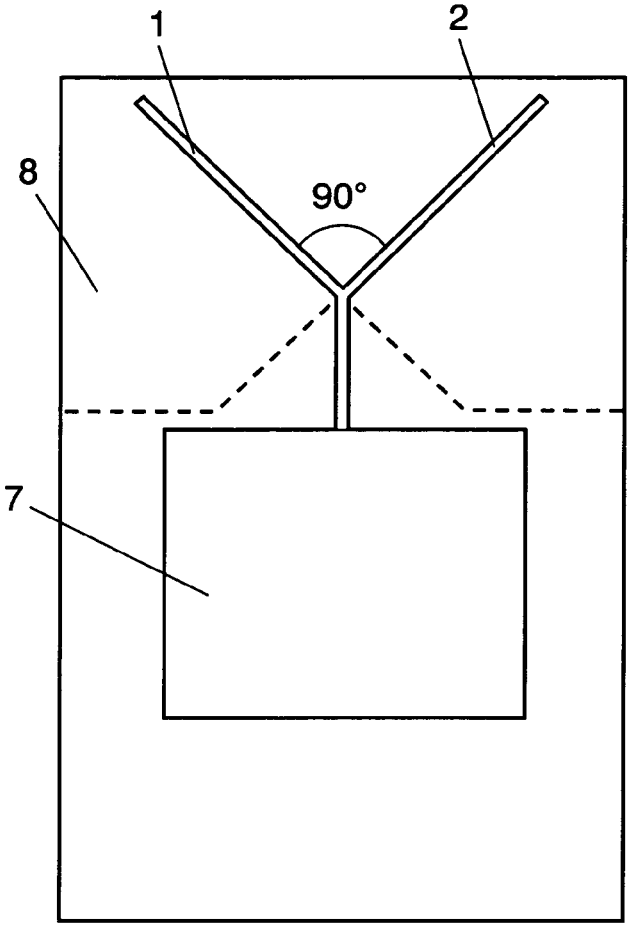
FIG. 10A is a top view of an antenna according to the embodiment of the present invention.
Figure 10B:
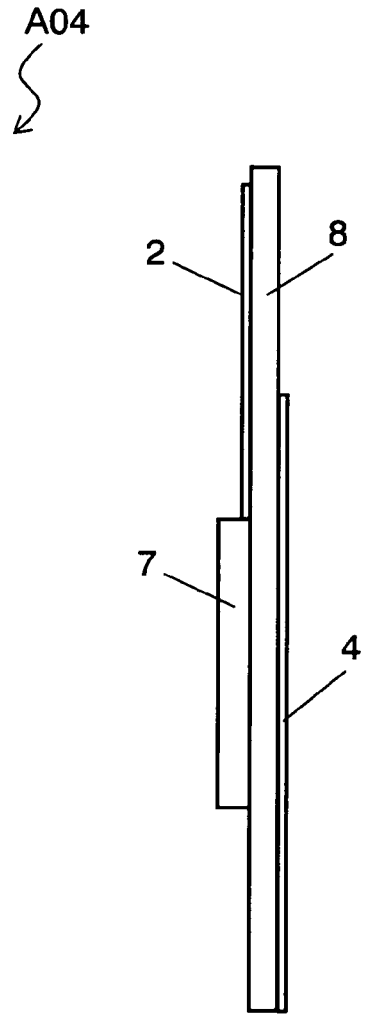
FIG. 10B is a side view of the antenna according to the embodiment of the present invention.
Figure 11A:
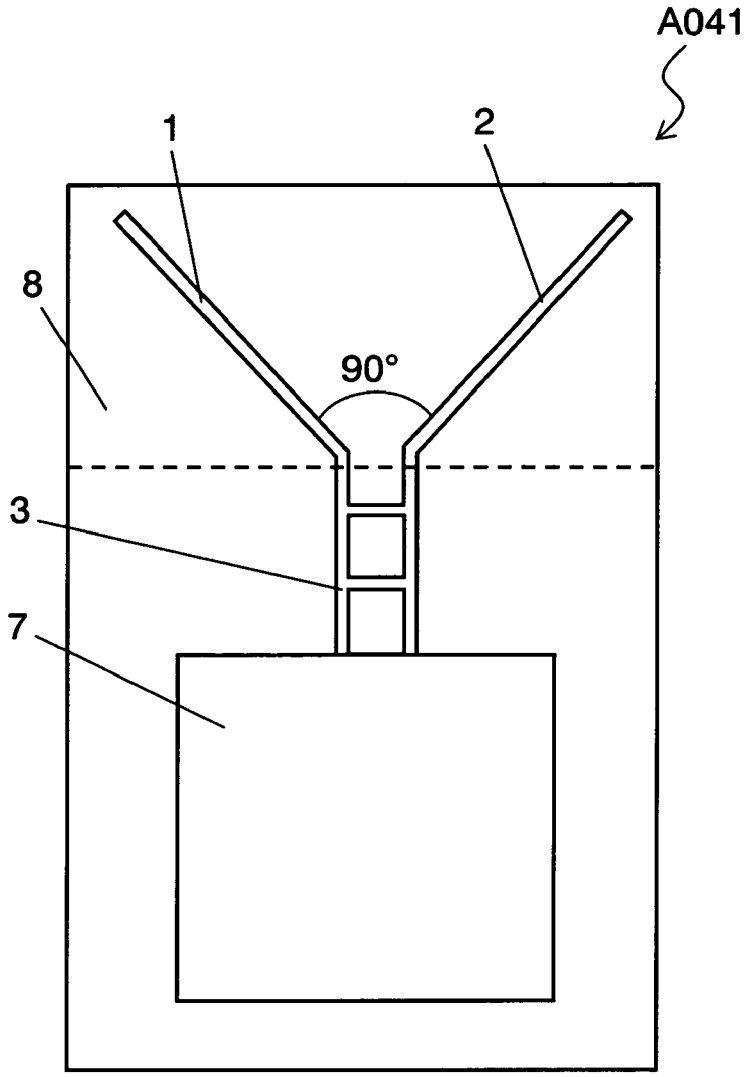
FIG. 11A is a top view of another antenna according to the embodiment of the present invention.
Figure 11B:
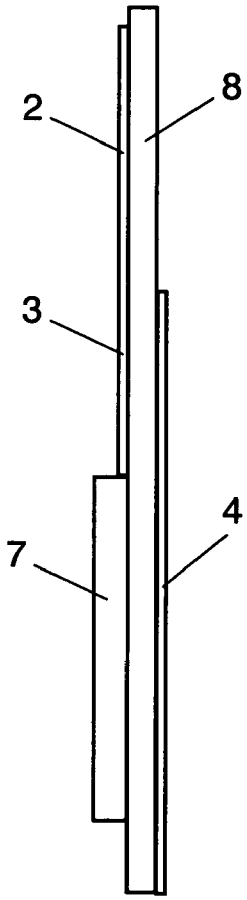
FIG. 11B is a side view of the other antenna according to the embodiment of the present invention.

FIGS. 10A and 10B show antenna A04 according to a fourth example of the present invention. Antenna A04 is made by combining antenna A02 according to the second example and high frequency printed circuit board 8. In other words, conductive elements 1 and 2 and high frequency circuit 7 are disposed on the top surface of high frequency printed circuit board 8, and ground plate 4 is formed on the rear surface. This structure can achieve an antenna capable of radiating circularly polarized waves in four directions with ease and at low cost. Similarly, antenna A041 shown in FIGS. 11A and 11B is made by combining antenna A01 according to the first example and high frequency printed circuit board 8.

Figure 12A:
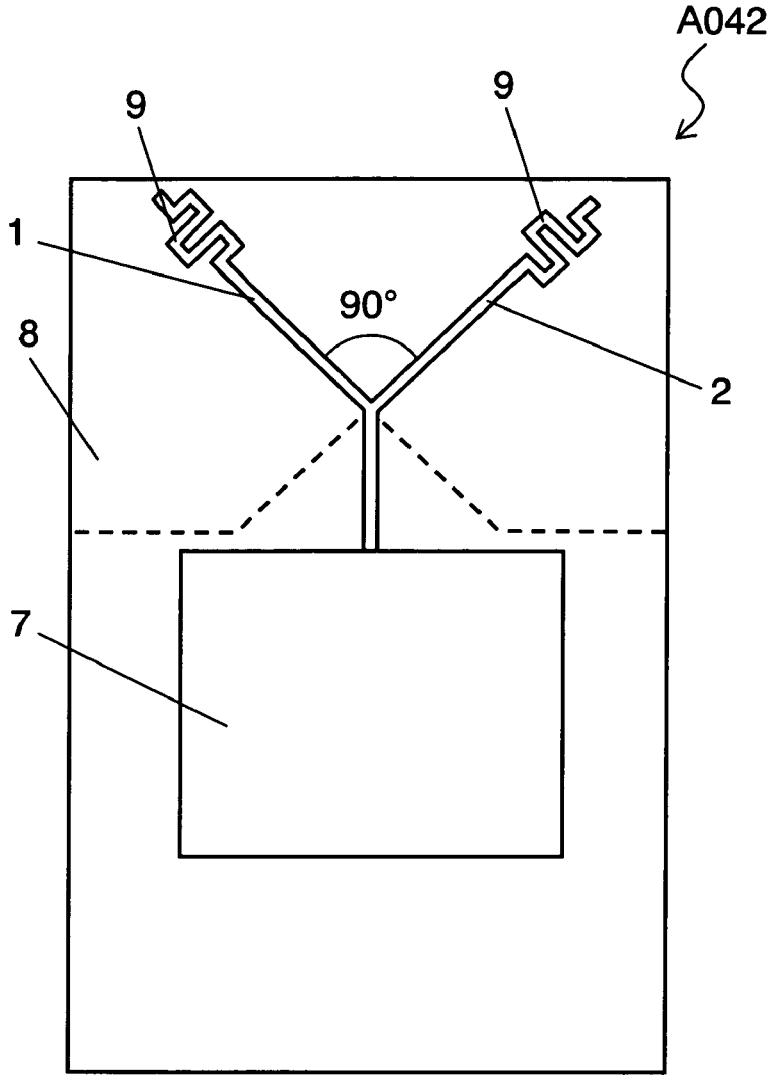
FIG. 12A is a top view of an antenna according to the embodiment of the present invention.
Figure 12B:
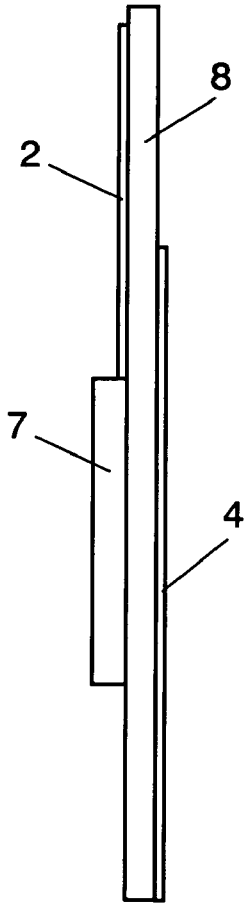
FIG. 12B is a side view of the antenna according to the embodiment of the present invention.

FIGS. 12A and 12B show a fifth example of the present invention. In antenna A042 shown in FIGS. 12A and 12B, conductive elements 1 and 2 are reduced in physical size by making the tip parts of conductive elements 1 and 2 used in the fourth example in a meander shape 9.

Figure 13:
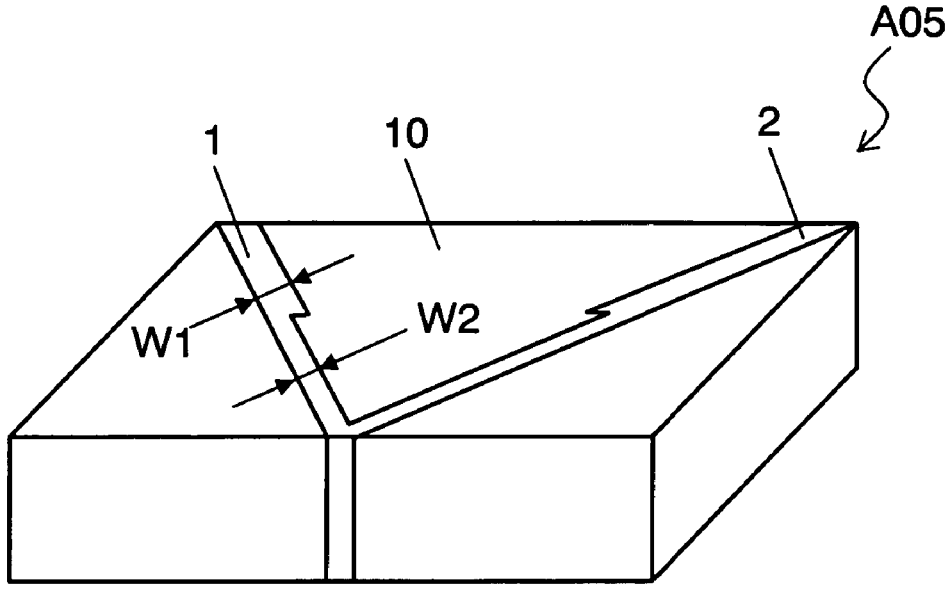
FIG. 13 is a perspective view of an antenna according to the embodiment of the present invention.

FIG. 13 shows antenna A05 in which conductive elements 1 and 2 are made of ceramics or the like. In FIG. 13, conductive elements 1 and 2 are formed on the top surface of ceramic substrate 10 by sintering conductive paste. Ceramic substrate 10 has at one end a power feed conductor (not illustrated) connected with one end of each of conductive elements 1 and 2, and is connected with a high frequency circuit (not illustrated) at the other end, thereby feeding signals into conductive elements 1 and 2.

Thus forming an antenna on the surface of ceramic substrate 10 can reduce wavelength by the dielectric constant of ceramics so as to miniaturize the antenna. Note that element width W1 in the vicinity of the open end of conductive elements 1 and 2 is made larger than element width W2 of the remaining parts of conductive elements 1 and 2. This design can reduce the impedance in the open end, thereby decreasing the physical length of the conductive elements. In the present example, elements 1 and 2 are formed on the surface of ceramic substrate 10; however, it goes without saying that the same effects could be obtained by forming elements 1 and 2 inside the substrate, and that the ceramics can be replaced by magnetic material.

Figure 14:
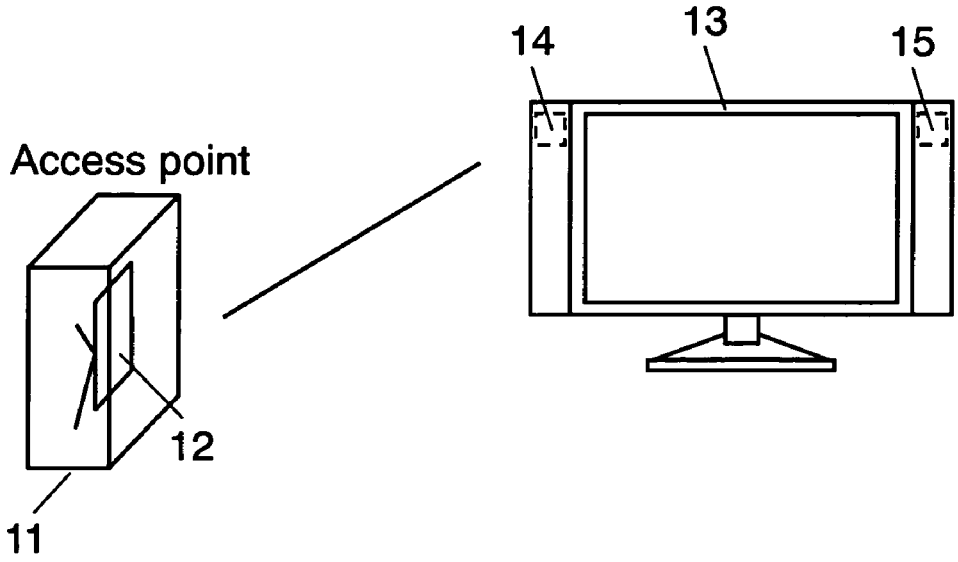
FIG. 14 is a schematic view of a communication device having the antenna of the present invention inside.

FIG. 14 shows a case where an antenna of the present embodiment is used in a communication device. Access point 11 mounted with antenna 12 of the present invention transmits image information, and AV device 13 such as a PDP or a liquid crystal TV having a right-hand circularly polarized antenna and a left-hand circularly polarized antenna receives the signals to reproduce images and the like. In a domestic environment with AV device 13, electromagnetic waves are reflected or diffracted by walls, floors, ceilings, human bodies or the like, so that the signals that the PDP or liquid crystal TV 13 receives are associated waves of the signals which passed through various paths (hereinafter referred to as multipath). Therefore, there may be a phenomenon that the level of the received signals is greatly deteriorated by phase reverse, thereby making it impossible to receive images.

To reduce this phenomenon requires decreasing the number of paths through which multipath waves to be received pass, thereby reducing the deterioration of received electric power due to the phase reverse of the received signals. For example, in a case where circularly polarized waves are used for radio communication, when reflected by a reflector such as a wall, right-hand circularly polarized waves are converted into left-hand circularly polarized waves, and left-hand circularly polarized waves are converted into right-hand circularly polarized waves. In other words, when the right-hand circularly polarized waves are transmitted from the transmission side, and received by a right-hand circularly polarized antenna, reflected waves, which have been once reflected by a reflector are not received because they are now left-hand circularly polarized waves, and only right-hand circularly polarized waves which are direct waves can be received. This enables a reduction in the number of multipath waves, thereby reducing the deterioration in the received electric power.

Note that the transmission antenna used in this case has to be a circularly polarized antenna having a radiation pattern close to nondirectional. In other words, since a liquid crystal TV is hardly fixed in a specific place because of its easiness to move around, it is preferable that the antenna at the access point to transmit image data is nondirectional. Using the circularly polarized antenna of the present invention can achieve desired characteristics by only one circularly polarized antenna, thereby providing a radio communication device at low cost. In FIG. 14, the circularly polarized waves transmitted from the antenna of the present invention held at access point 11 such as an STB (set top box) are received by a diversity antenna consisting of right-hand circularly polarized antenna 14 and lift-hand circularly polarized antenna 15 held in AV device 13 such as a liquid crystal TV. As a result, excellent image reception can be achieved even when AV device 13 moves to an arbitrary place inside the room.

Figure 15A:
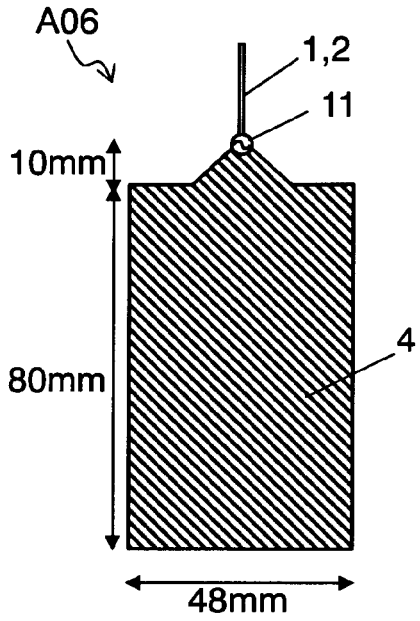
FIG. 15A is a side view of an antenna according to the embodiment of the present invention.
Figure 15B:
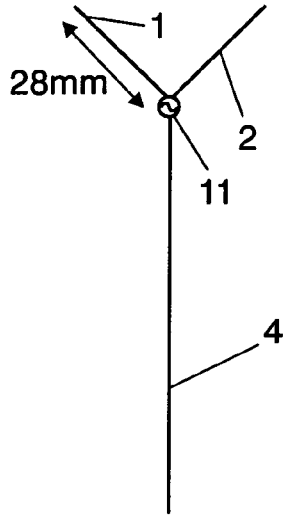
FIG. 15B is a side view of the antenna according to the embodiment of the present invention.
Figure 15C:
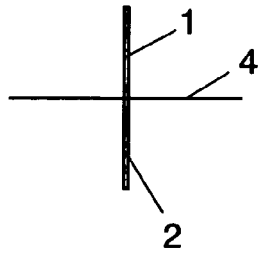
FIG. 15C is a top view of the antenna according to the embodiment of the present invention.
Figure 15D:
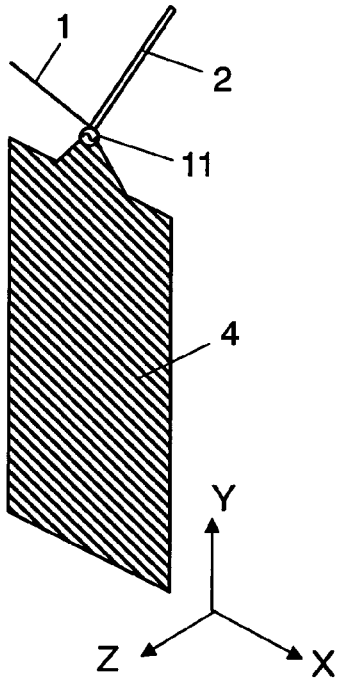
FIG. 15D is a perspective view of the antenna according to the embodiment of the present invention.
Figure 16A:
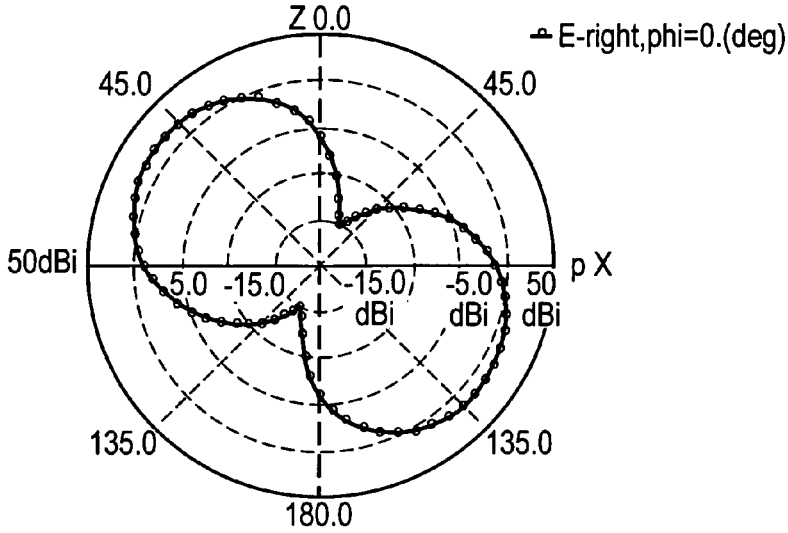
FIG. 16A is a view showing right-hand circular polarization radiation characteristics when conductive elements according to the embodiment of the present invention have an element length of λ/2.
Figure 16B:
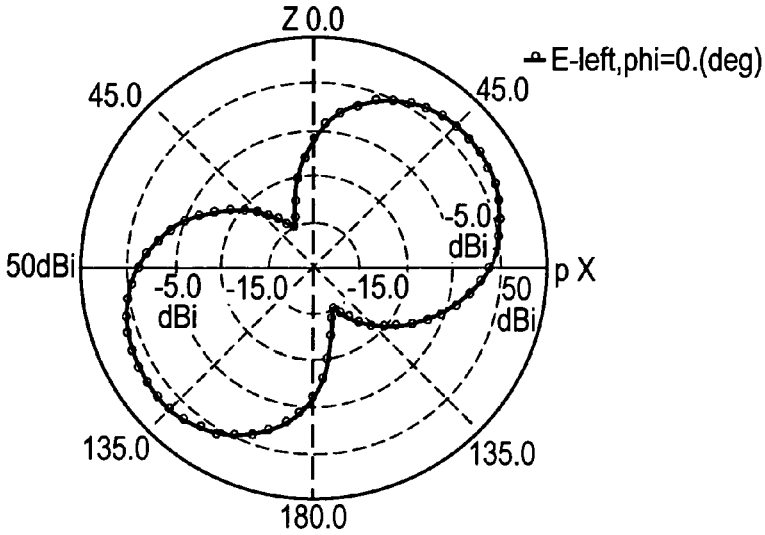
FIG. 16B is a view showing left-hand circular polarization radiation characteristics when the conductive elements according to the embodiment of the present invention have an element length of λ/2.
Figure 16C:
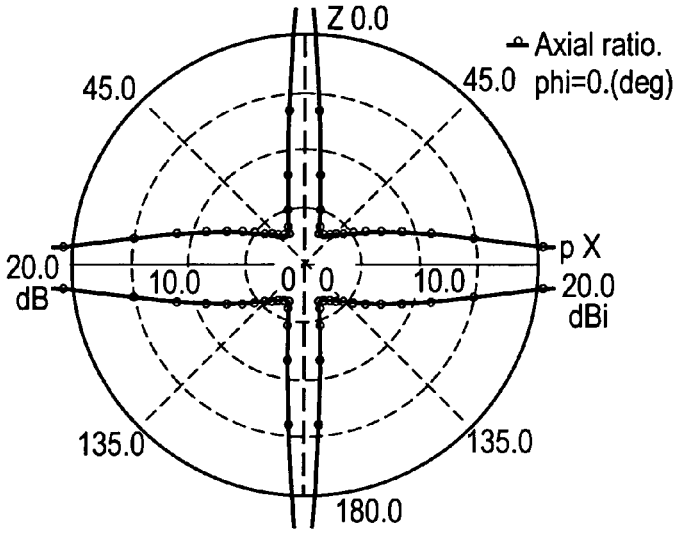
FIG. 16C is a view showing axial ratio characteristics when the conductive elements according to the embodiment of the present invention have an element length of λ/2.

Antenna A06 according to a sixth example of the present invention will be described as follows with FIGS. 15A–15D and 16A–16C. FIGS. 15A–15D show three side views of antenna A06 simplified for easier understanding of the behavior of the antenna. In these views, first conductive element 1 and second conductive element 2 are electrically connected with each other at one end of each, and power feed part 11 is connected between the connection part and ground 4. In this antenna model, first and second conductive elements 1 and 2 have an element length of 28 mm, and ground 4 has a dimension of 80 mm×48 mm. Ground 4 is coupled with a triangular ground having an apex of 90° (10 mm in height) which is connected with power feed part 11. FIG. 15D shows a perspective view of antenna A06. FIGS. 16A–16C show the antenna characteristics in 4.85 GHz of antenna A06 according to the present example. FIGS. 16A and 16B show the radiation patterns (on surface XZ) of a right-hand circular polarization component and a left-hand circular polarization component, respectively. These views indicate that the circularly polarized waves are radiated in such a manner that the respective radiation gain peaks are displaced 90° with respect to each other. FIG. 16C shows the axial ratio characteristics on surface ZX. It is apparent from these results that excellent axial ratio characteristics have been achieved in four directions, which are the directions of ±45° and ±35° on surface ZX.

Thus, the simple antenna structure shown in FIG. 15 enables circularly polarized waves to be radiated in four directions, thereby providing a circularly polarized antenna with almost nondirectional radiation patterns at low cost.

Figure 17A:
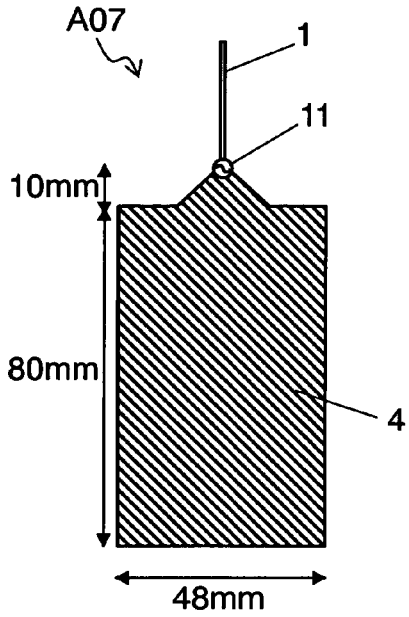
FIG. 17A is a side view of an antenna according to the embodiment of the present invention.
Figure 17B:
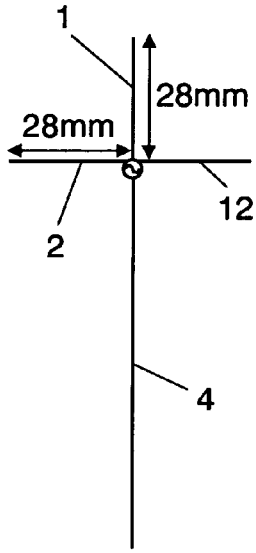
FIG. 17B is a side view of the antenna according to the embodiment of the present invention.
Figure 17C:
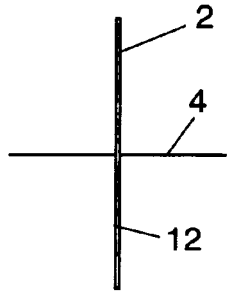
FIG. 17C is a top view of the antenna according to the embodiment of the present invention.
Figure 17D:
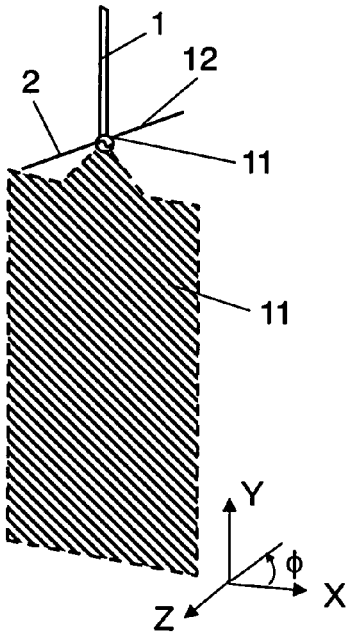
FIG. 17D is a perspective view of the antenna according to the embodiment of the present invention.
Figure 18A:
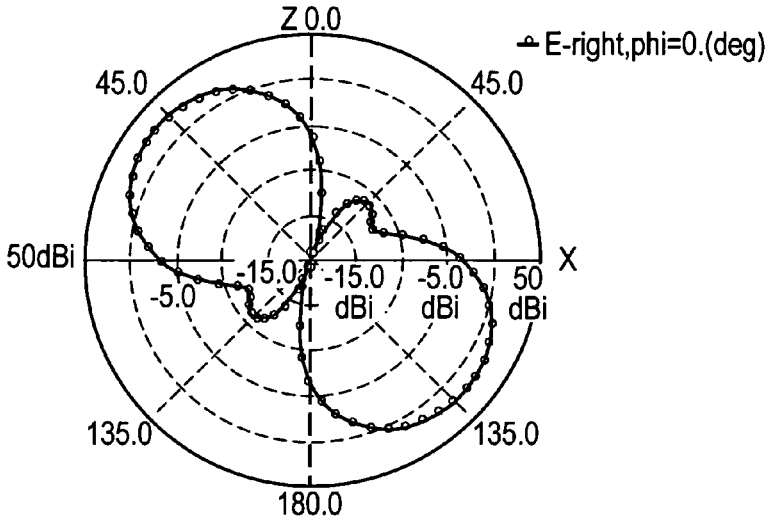
FIG. 18A is a view showing right-hand circular polarization radiation characteristics when conductive elements according to the embodiment of the present invention have an element length of λ/2.
Figure 18B:
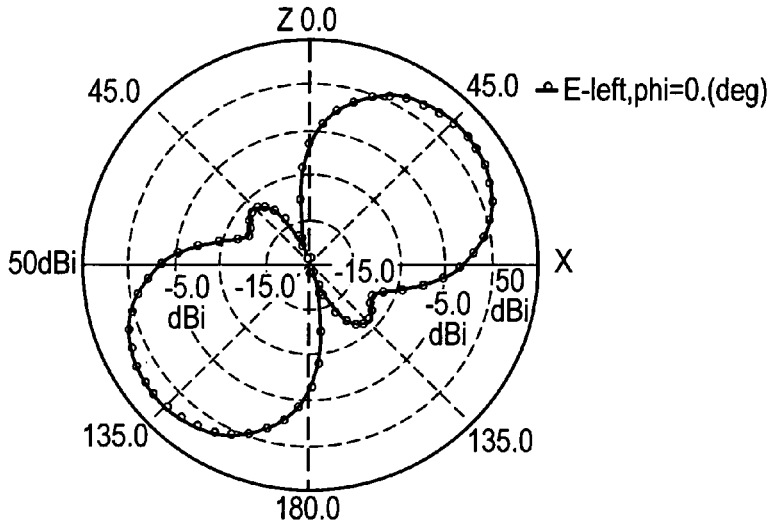
FIG. 18B is a view showing left-hand circular polarization radiation characteristics when the conductive elements according to the embodiment of the present invention have an element length of λ/2.
Figure 18C:
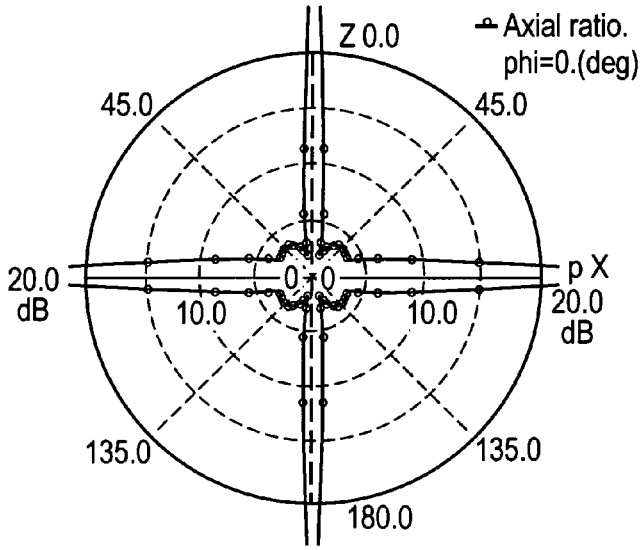
FIG. 18C is a view showing axial ratio characteristics (Φ=0°) when the conductive elements according to the embodiment of the present invention have an element length of λ/2.
Figure 18D:
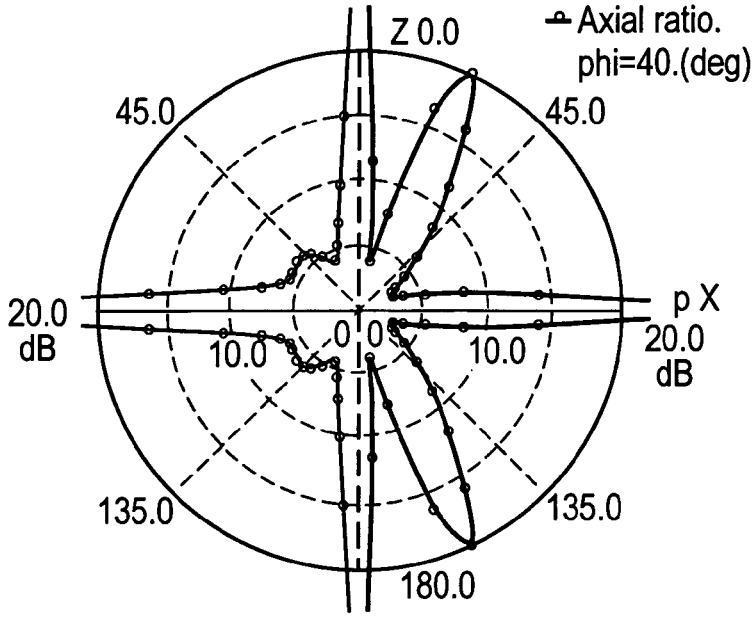
FIG. 18D is a view showing axial ratio characteristics (Φ=40°) when the conductive elements according to the embodiment of the present invention have an element length of λ/2.
Figure 18E:
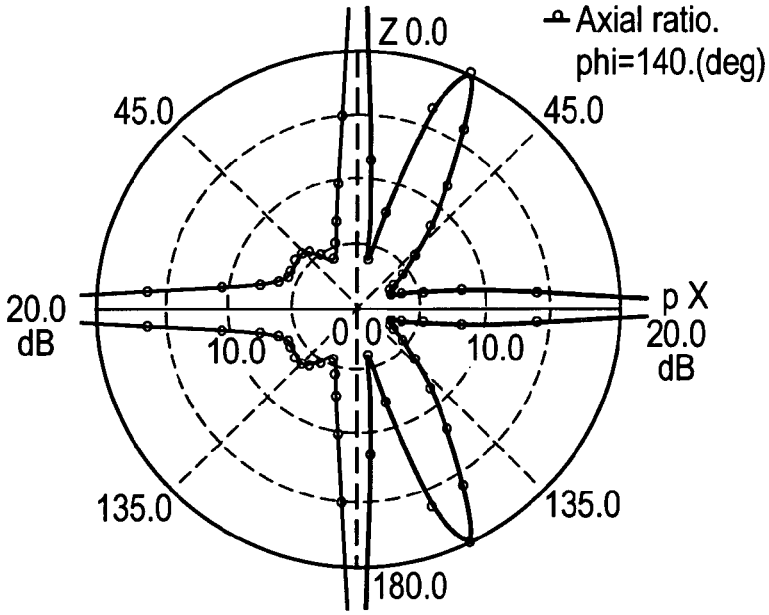
FIG. 18E is a view showing axial ratio characteristics (Φ=140°) when the conductive elements according to the embodiment of the present invention have an element length of λ/2.

FIGS. 17A–17D and 18A–18E show antenna A07 according to a seventh example of the present invention. The same components as those in antenna A06 according to the sixth example are referred to with the same reference numerals and their description will not be repeated. FIGS. 17A, 17B and 17C show three side views of the antenna model which is simplified for easier understanding of the behavior of the antenna. Antenna A07 includes three conductive elements. First conductive element 1 is disposed in the direction parallel to axis Y, and second and third conductive elements 2 and 12 are disposed respectively in the directions of axis±Z, these three elements being connected with power feed part 11 at one end of each. Conductive elements 1, 2 and 12 all have a length of 28 mm. FIG. 17D shows a perspective view of this antenna model. FIGS. 18A–18E show the antenna characteristics in 5.15 GHz of the antenna model shown in FIG. 17A–17D. FIGS. 18A and 18B show the radiation patterns (on surface XZ) of a right-hand circular polarization component and a left-hand circular polarization component, respectively. These views indicate that the circularly polarized waves are radiated in such a manner that the respective radiation gain peaks are displaced 90° with respect to each other. FIGS. 18C, 18D and 18E show the axial ratio characteristics in the directions of F=0°, 40°and 140°, respectively. Here, the angle F indicates an angle formed with axis X on surface XY as shown in FIG. 17D.

It is apparent from FIG. 18C that when F=0°, excellent axial ratio characteristics are achieved except for axes X and Z. FIGS. 18D and 18E indicate that low axial ratio characteristics are achieved when F=40° and 140°, respectively. Such excellent axial ratio characteristics in multi directions probably result from the radiation of circularly polarized waves by using two combinations of elements: a first combination of first and second conductive elements 1 and 2 disposed with an angle of 90° and a second combination of first and third conductive elements 1 and 12 disposed with an angle of 90°. Thus, antenna A07 shown in FIGS. 17A–17D can achieve the radiation of circularly polarized waves in multi directions by a simple structure. In antenna A07 according to the seventh example, the tip portions of conductive elements 1, 2 and 12 may be formed in a helical shape, a meander shape or a zigzag shape.

Figure 19A:
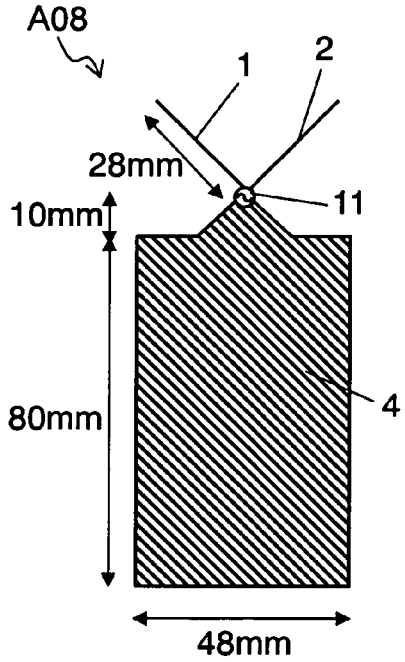
FIG. 19A is a side view of an antenna according to the embodiment of the present invention.
Figure 19B:
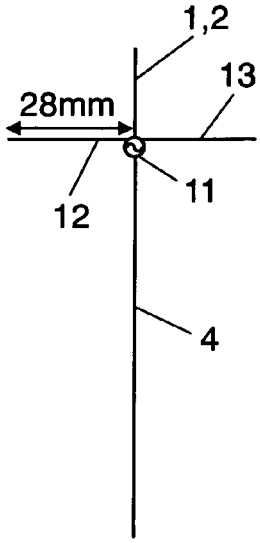
FIG. 19B is a side view of the antenna according to the embodiment of the present invention.
Figure 19C:
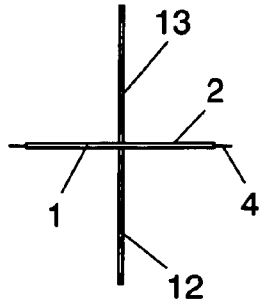
FIG. 19C is a top view of the antenna according to the embodiment of the present invention.
Figure 19D:
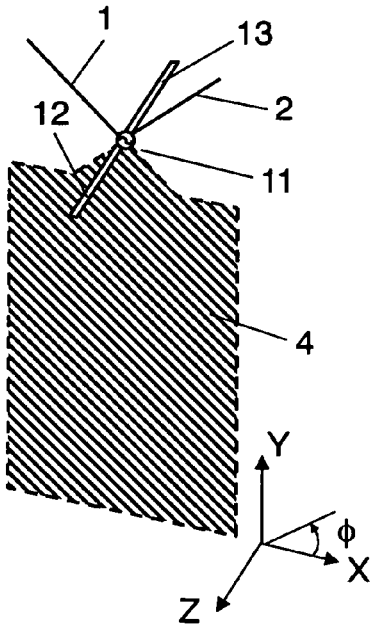
FIG. 19D is a perspective view of the antenna according to the embodiment of the present invention.
Figure 20A:
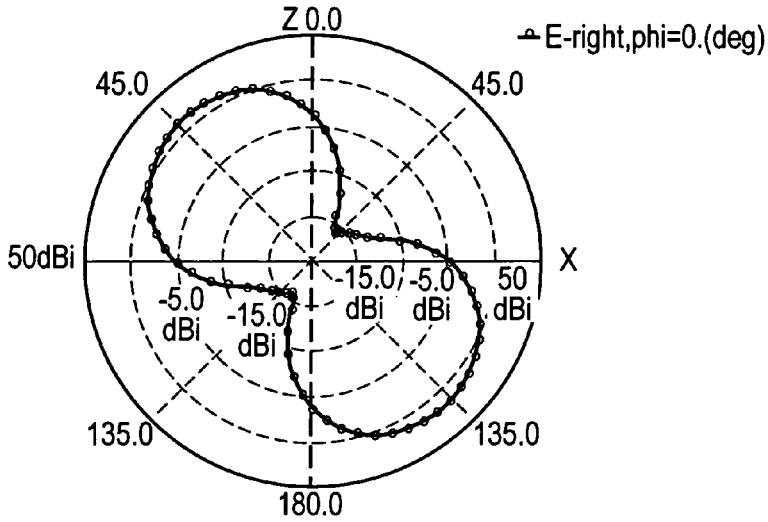
FIG. 20A is a view showing right-hand circular polarization radiation characteristics when conductive elements according to the embodiment of the present invention have an element length of λ/2.
Figure 20B:
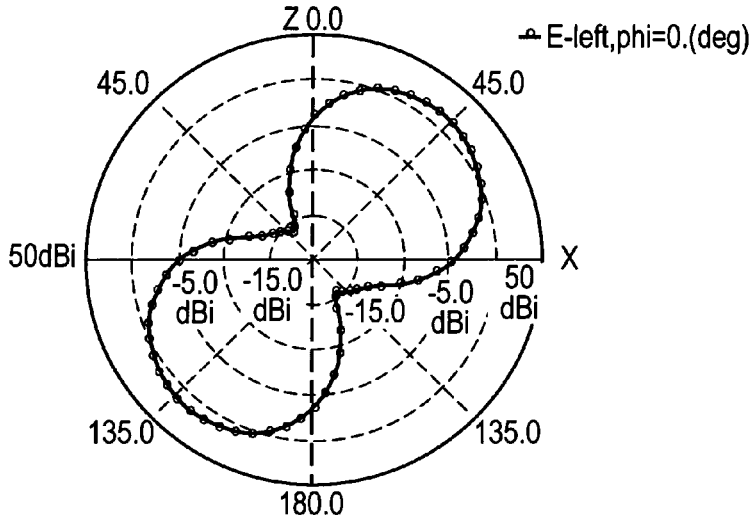
FIG. 20B is a view showing left-hand circular polarization radiation characteristics when the conductive elements according to the embodiment of the present invention have an element length of λ/2.
Figure 20C:
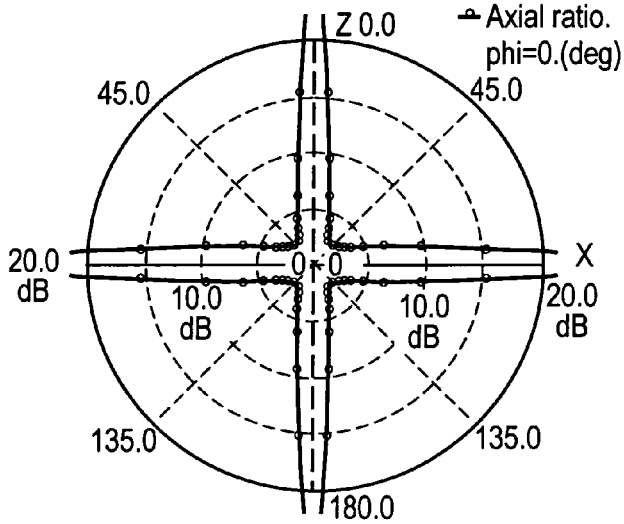
FIG. 20C is a view showing axial ratio characteristics (Φ=0°) when the conductive elements according to the embodiment of the present invention have an element length of λ/2.
Figure 20D:
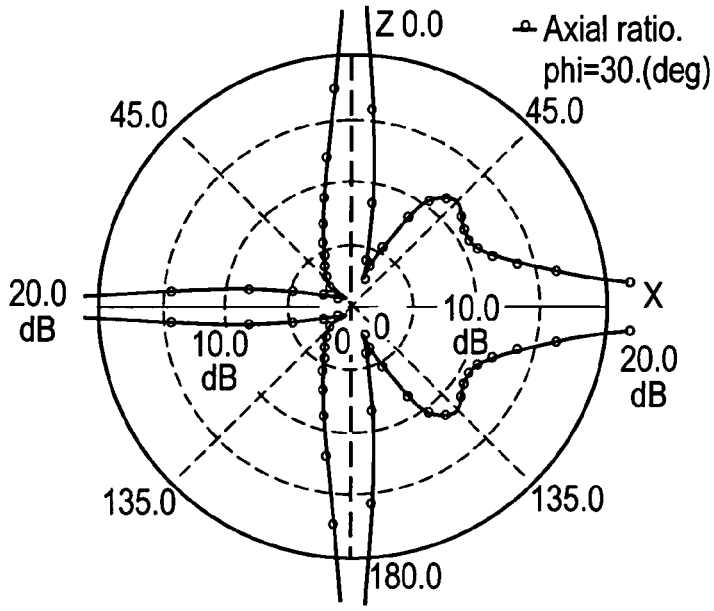
FIG. 20D is a view showing axial ratio characteristics (Φ=30°) when the conductive elements according to the embodiment of the present invention have an element length of λ/2.
Figure 20E:
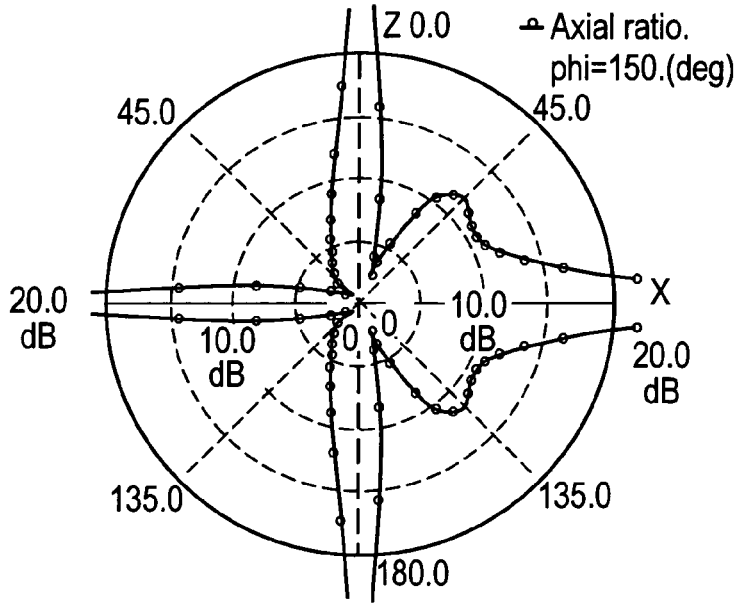
FIG. 20E is a view showing axial ratio characteristics (Φ=150°) when the conductive elements according to the embodiment of the present invention have an element length of λ/2.

Antenna A08 according to an eighth example of the present invention will be described as follows with FIGS. 19A–19D and 20A–20E. The components having the same structure as those in antenna A06 according to the sixth example will be referred to with the same reference numerals, and their description will not be repeated. FIGS. 19A, 19B and 19C show three side views of the antenna model which is simplified for easier understanding of the behavior of the antenna. First and second conductive elements 1 and 2 are disposed in the same manner as in antenna A02 according to the second example, and third conductive element 12 and fourth conductive element 13 are disposed in the directions of axis ±Z in such a manner as to be connected with power feed part 11 at one end of each. FIG. 19D shows a perspective view of the antenna model. FIGS. 20A–20E show the radiation characteristics in 4.85 GHz of antenna A08. FIGS. 20A and 20B show the radiation patterns (on surface XZ) of a right-hand circular polarization component and a left-hand circular polarization component, respectively. It is apparent from these views that the circularly polarized waves are radiated in such a manner that the respective radiation gain peaks are displaced 90° with respect to each other. FIGS. 20C, 20D and 20E show the axial ratio characteristics when F=0°, 30° and 150°, respectively. Here, the angle F indicates an angle formed with axis X on surface XY as shown in FIG. 19D.

It is apparent from FIG. 20C that when F=0°, excellent axial ratio characteristics are achieved except for axes X and Z. FIGS. 20D and 20E indicate that low axial ratio characteristics are achieved when F=30° and 150°, respectively. Such excellent axial ratio characteristics in multi directions probably result from the radiation of circularly polarized waves by using five combinations of elements disposed with an angle of 90°: a first combination of first and second conductive elements 1 and 2; a second combination of third and first conductive elements 12 and 1; a third combination of third and second conductive elements 12 and 2; a fourth combination of fourth and first conductive elements 13 and 1; and a fifth combination of fourth and second conductive elements 13 and 2. Thus, antenna A08 shown in FIGS. 19A–19D can achieve the radiation of circularly polarized waves in multi directions by a simple structure.

Figure 21A:
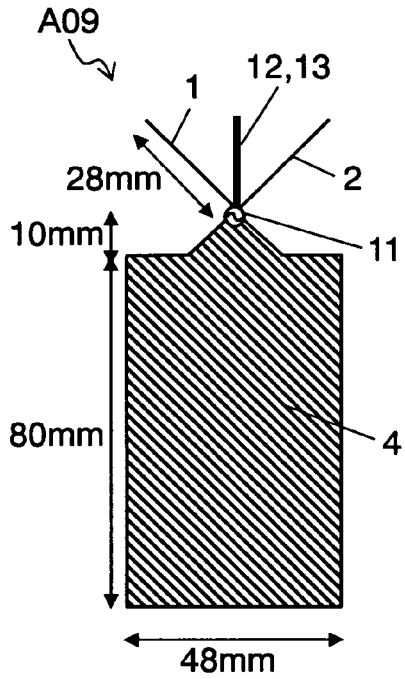
FIG. 21A is a side view of an antenna according to the embodiment of the present invention.
Figure 21B:
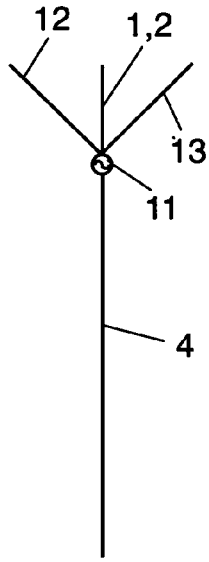
FIG. 21B is a side view of the antenna according to the embodiment of the present invention.
Figure 21C:
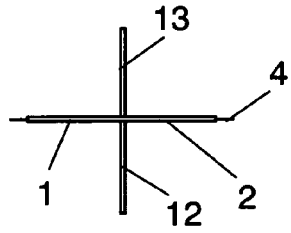
FIG. 21C is a top view of the antenna according to the embodiment of the present invention.
Figure 21D:
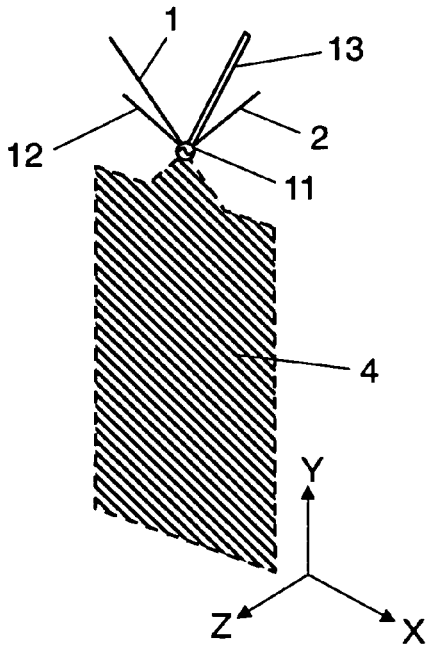
FIG. 21D is a perspective view of the antenna according to the embodiment of the present invention.
Figure 22A:
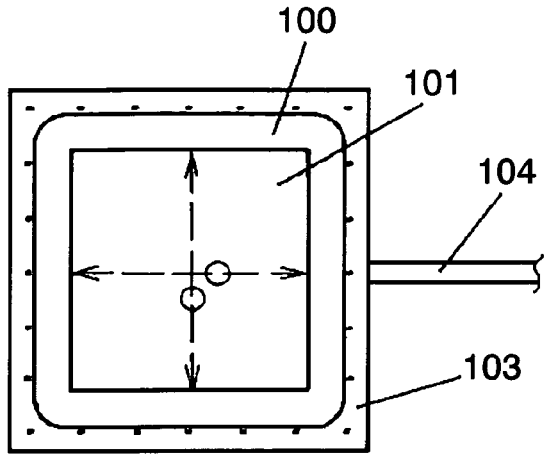
FIG. 22A is a top view of a conventional antenna.
Figure 22B:
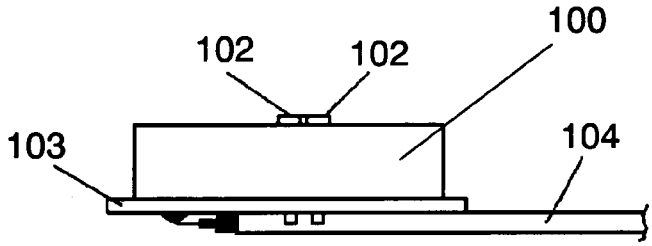
FIG. 22B is a front view of the conventional antenna.
Figure 22C:
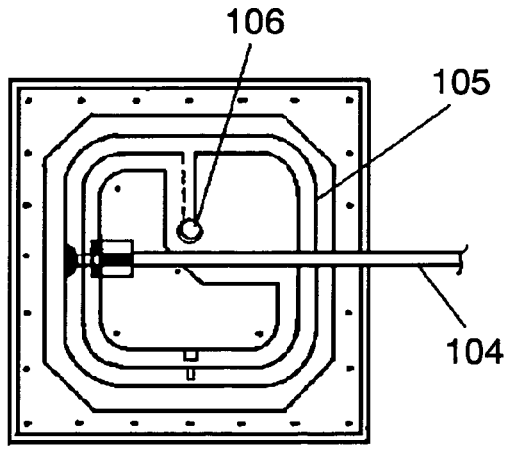
FIG. 22C is a bottom view of the conventional antenna.

One example of the structure of antenna A09 according to a ninth example using four conductive elements is shown in FIGS. 21A–21D. The same components as those in antenna A06 are referred to with the same reference numerals and their description will not be repeated. FIGS. 21A, 21B and 21C show three side views of the antenna. First and second conductive elements 1 and 2 are disposed in the same positions as in antenna A02 according to the second example. Third and fourth conductive elements 12 and 13 are disposed in the same positions as first and second conductive elements 1 and 2 of antenna A06 according to the sixth example. The antenna structure shown in the ninth example can achieve the radiation of circularly polarized waves with excellent axial ratio characteristics in multi directions.

INDUSTRIAL APPLICABILITY

The antenna and electronic device using the antenna according to the present invention includes two conductive elements which are disposed with an angle of 90° so as to be fed the same signal power with a phase difference of 90°, and a power feed circuit which is connected at one end with a high frequency circuit and connected at the other end with one end of each of the conductive elements. Since the conductive elements are disposed with an angle of 90° and fed with a phase difference of 90°, the antenna can radiate circularly polarized waves in the direction orthogonal to the surface where the two conductive elements are present in spite of having a simple structure and low cost. This antenna is useful as an antenna resistant to multipath fading.

The invention claimed is:

1. An antenna comprising:

a ground plate;

a plurality of conductive elements placed so as not to face the ground plate and each having an electric length of about λ/2; and a high frequency circuit, connected to at least two conductive elements of the plurality of conductive elements, wherein the at least two conductive elements are arranged to form a letter "V" with an angle of substantially 90°, one end of each of the at least two conductive elements are connected at a connection point, and the high frequency circuit is connected to the connection point.

2. The antenna according to claim 1 further comprising a power feed circuit, wherein the power feed circuit feeds same signal power into the at least two conductive elements arranged to form the letter "V" with a phase difference of 90°.

3. The antenna according to claim 2, wherein the power feed circuit is made up of a hybrid circuit.

4. The antenna according to claim 1, wherein the ground has an apex of 90°, and the at least two conductive elements arranged to form the letter "V" are disposed at the apex.

5. The antenna according to claim 1, wherein the plurality of conductive elements have a portion with a helical shape or a meander shape.

6. The antenna according to claim 1, wherein at least one of a power feed circuit or the plurality of conductive elements are made of a conductive pattern formed on a high frequency printed circuit board.

7. The antenna according to claim 1, wherein the plurality of conductive elements are formed one of on or inside a substrate which is made of one of dielectric ceramic material or magnetic material.

8. The antenna according to claim 1, wherein the ground has an apex of 90°, a surface including the at least two conductive elements which are disposed at the apex and which are arranged to form the letter "V" is orthogonal to a surface of the ground.

9. An electronic device using the antenna of claim 1.

10. The antenna according to claim 1, wherein the at least two conductive elements are feed with the same phase.

11. The antenna according to claim 1, wherein circularly polarized waves are radiated in multiple directions.

* * * * *